United States Patent [19]

Skinner

[11] Patent Number: 4,499,884

[45] Date of Patent: Feb. 19, 1985

[54] FUEL INJECTION PUMPS

[75] Inventor: Robert T. J. Skinner, High Wycombe, England

[73] Assignee: Lucas Industries Public Limited Company, Birmingham, England

[21] Appl. No.: 551,161

[22] Filed: Nov. 14, 1983

[30] Foreign Application Priority Data

Dec. 8, 1982 [GB] United Kingdom ..... 8235049

[51] Int. Cl.[3] ..... F02M 41/08; F02M 37/04

[52] U.S. Cl. ..... 123/506; 123/450; 123/467; 123/516; 417/462

[58] Field of Search ..... 123/450, 467, 516, 506; 417/462

[56] References Cited

U.S. PATENT DOCUMENTS

| | | | |
|---|---|---|---|
| 2,537,371 | 1/1951 | Petersen | 123/506 |
| 2,989,003 | 6/1961 | Evans | 417/462 |
| 4,211,203 | 7/1980 | Kobayashi | 123/506 |
| 4,271,808 | 6/1981 | Kobayashi | 123/506 |
| 4,309,151 | 1/1982 | Craven | 417/462 |
| 4,327,696 | 5/1982 | Kobayashi | 123/506 |
| 4,351,283 | 9/1982 | Ament | 123/506 |
| 4,381,182 | 4/1983 | Broadwith | 417/462 |
| 4,446,836 | 5/1984 | Mowbray | 417/462 |

FOREIGN PATENT DOCUMENTS

| | | | |
|---|---|---|---|
| 1210234 | 10/1970 | United Kingdom | 417/462 |

*Primary Examiner*—Charles J. Myhre
*Assistant Examiner*—Carl Stuart Miller

[57] ABSTRACT

A fuel injection pump includes a rotary distributor having a bore housing a pair of pumping plungers which are actuated by a cam. The distributor member also carries a valve member which is actuated by a cam. The valve member has a groove which can spill fuel to a drain when the valve member is moved to an operative position. In addition the valve member restricts the backflow of fuel from an outlet when fuel is spilled from the bore.

12 Claims, 8 Drawing Figures

FUEL INJECTION PUMPS

Figure 1:
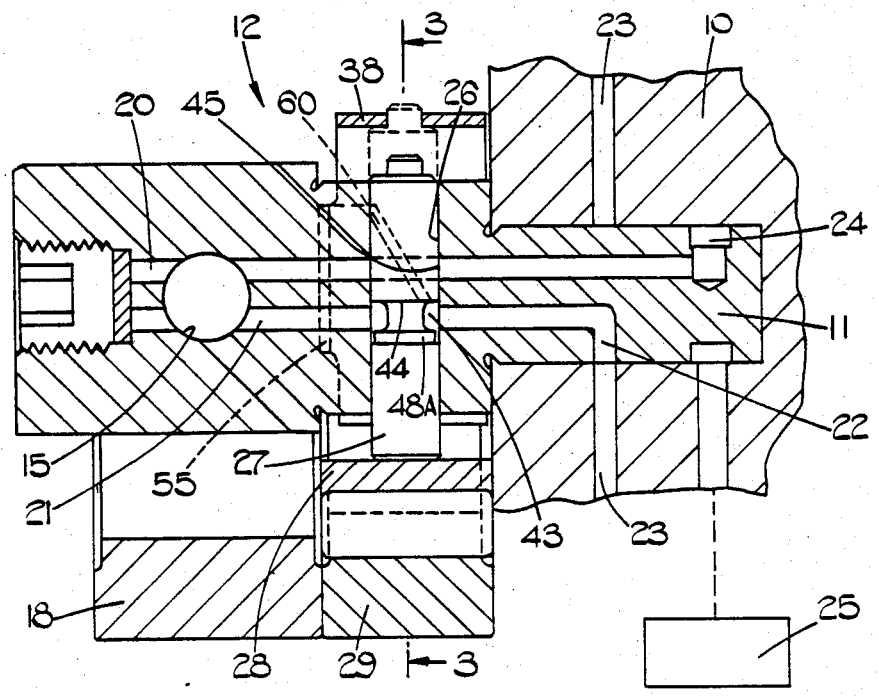

This invention relates to rotary distributor type fuel injection pumps for supplying fuel to internal combustion engines more particularly of the compression ignition type, the pump comprising a rotary distributor member mounted in a pump body and arranged in use to be driven in timed relationship with the associated engine, a pump bore formed in the distributor member, a reciprocable pumping plunger slidable in the pump bore, cam means including a cam lobe for effecting inward movement of the pumping plunger as the distributor member rotates, a delivery passage in the distributor member and an outlet port in the body, said delivery passage communicating with said pump bore and being positioned to register with said outlet when fuel is displaced from said pump bore, means for supplying fuel to said pump bore and fuel control means for controlling the amount of fuel supplied to said outlet, said fuel control means including a valve member carried by the distributor member and further cam means for actuating said valve member, said valve member when in an operative position causing fuel to spill from said pump bore.

Pumps of the aforesaid kind can be divided into two classes the first being where fuel control is effected by controlling the amount of fuel supplied to the bore during the filling period and the second class being where fuel control is effected by spilling fuel from the bore during the inward movement of the plunger. The second class of pump has the important advantage that the stresses within the pump are lower particularly the stress experienced by the cam lobe. This is because in the first class of pump, pumping takes place over the crest of the cam lobe.

The present invention is concerned with the second class of pump. A known form of this type of pump has a distributor member which is provided with a so-called spill muff. The muff defines a spill port or groove and is movable angularly about the axis of rotation of the distributor member to vary the amount of fuel supplied to the outlet. In the case where a groove is used this may be inclined to the axis of rotation and the muff can be moved axially to vary the timing of fuel delivery. The provision of a spill muff requires that the distributor member should be lengthened and it also introduces additional leakage paths for the fuel at high pressure. It is desirable to achieve rapid opening of the spill port, for the diameter of the distributor member to be as large as possible. This however increases the problem of leakage. If on the other hand the diameter of the distributor member is made small the rate of opening of the spill port is reduced and problems can arise with erosion of the surfaces defining the spill port.

A further known form of the so called second class of pump is described in British Patent Specification No. 1476629. The pump described therein is again of the rotary distributor type and it has mounted in the distributor member a valve which can be actuated by a cam profile formed on the internal peripheral surface of a cam ring mounted in the body of the apparatus. The valve is actuated by the cam profile to spill fuel from the bore which contains the pumping plunger towards the end of the inward movement of the plunger. The angular position of the cam ring can be varied so that the position during the inward movement of the plunger at which spill takes place, can be varied thus varying the amount of fuel supplied through the outlet and hence to the associated engine. In the example described in the aforesaid specification the fuel is spilled to the interior of the pump housing which in use is normally connected to a drain. Moreover, the fuel spills from the bore containing the pumping plunger and from the outlet connected to the bore at an unrestricted rate. The pump will inevitably incorporate an unloading delivery valve or valves, single valve being possible when the pump has a number of outlets, by locating the signal delivery valve in the distributor member. The uncontrolled drop in pressure in the bore when the spill valve opens is immaterial but the drop of pressure so far as the delivery valve is concerned, leads to rapid closure thereof. The possibility then arises that pressure waves may occur in the pipeline connecting the outlet with its associated fuel injection nozzle causing secondary injection of fuel.

The object of the present invention is to provide a pump of the kind specified in a simple and convenient form.

According to the invention in a pump of the kind specified said valve member is slidable in a radial bore formed in the distributor member, a pair of ports opening into said bore at axially spaced positions, one of said ports communicating with said delivery passage and the other port with a low pressure, said valve member being of cyclindrical form having a groove intermediate its ends, said groove communicating with said pump bore, the arrangement being such that when the valve member is in its inoperative position said one port will be open to said groove and the pump bore but in the operative position of the valve member, said other port will be open to said groove to allow fuel to spill from the bore, the one port during movement of the valve member to its operative position being progressively covered to control the rate at which fuel can flow from said outlet.

Figure 3:
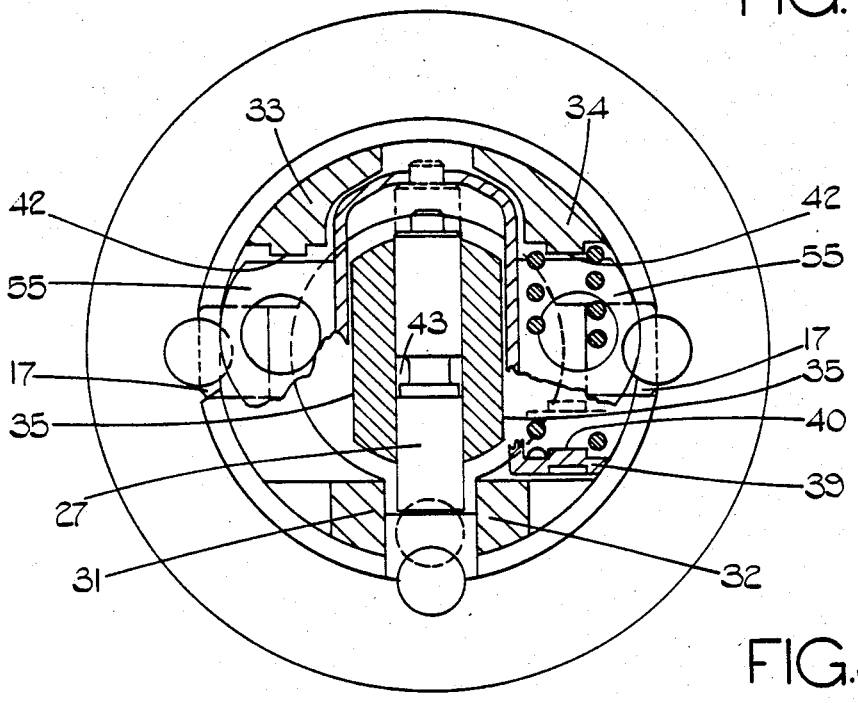
Figure 2:
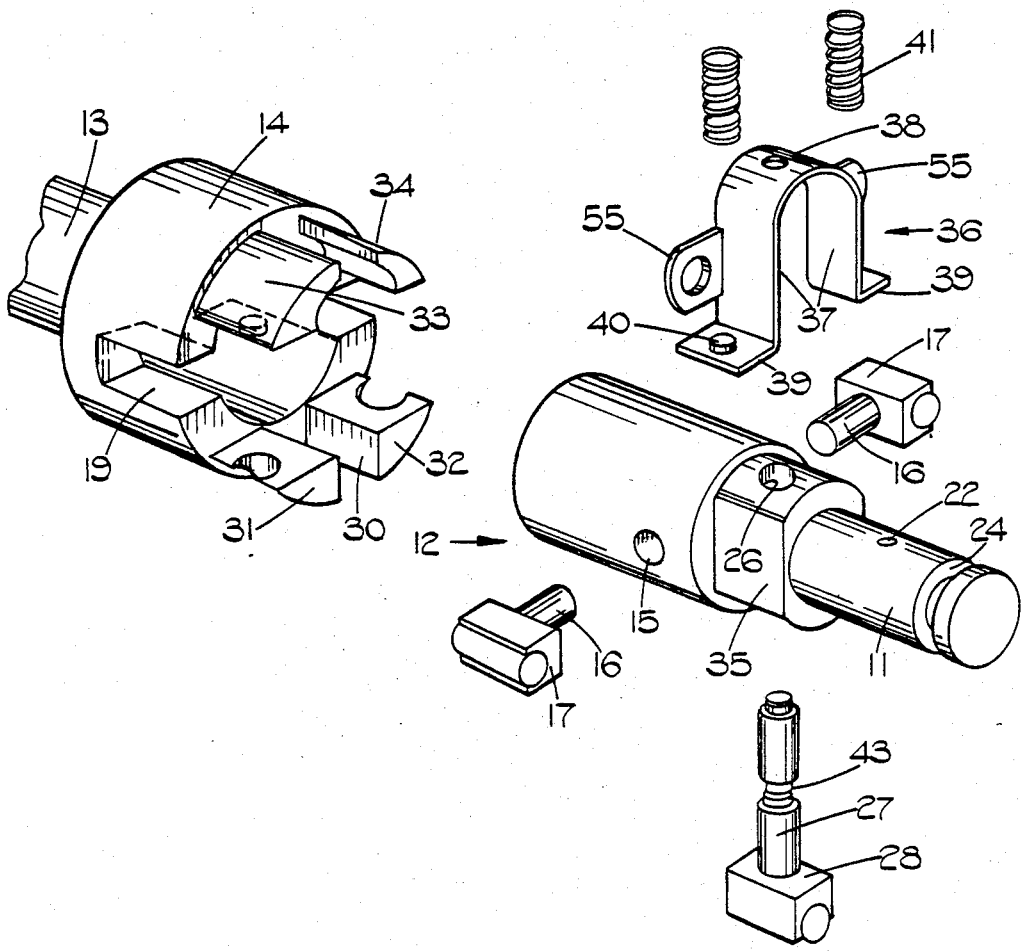
Figure 4:
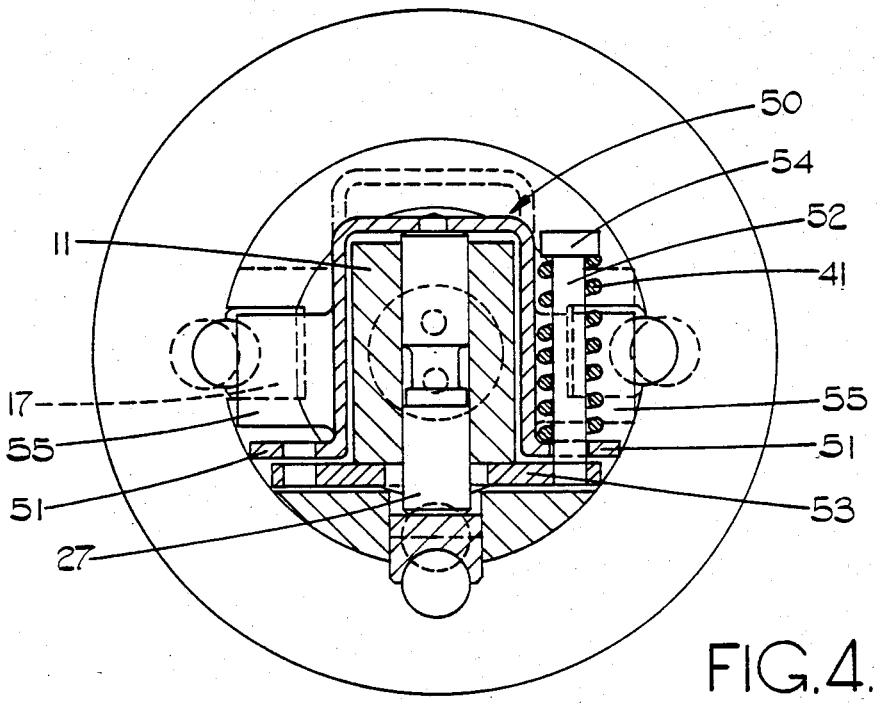
Figure 5:
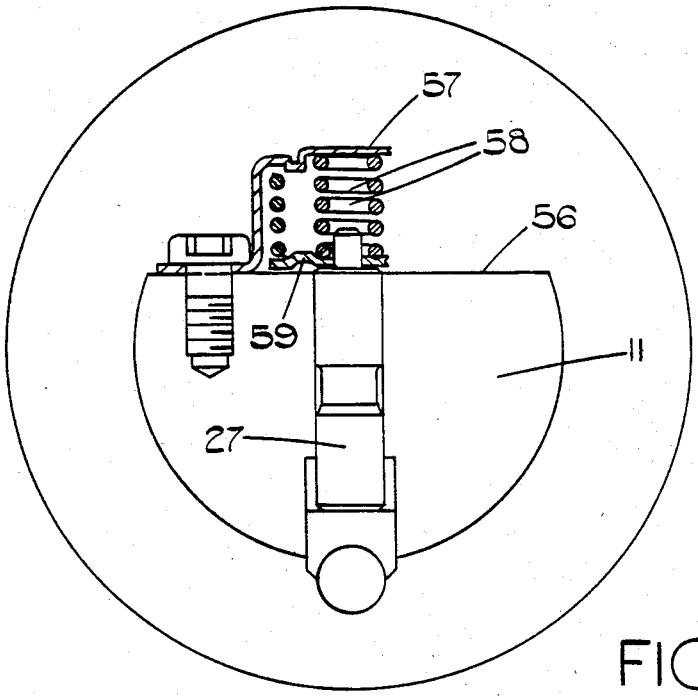
Figure 6:
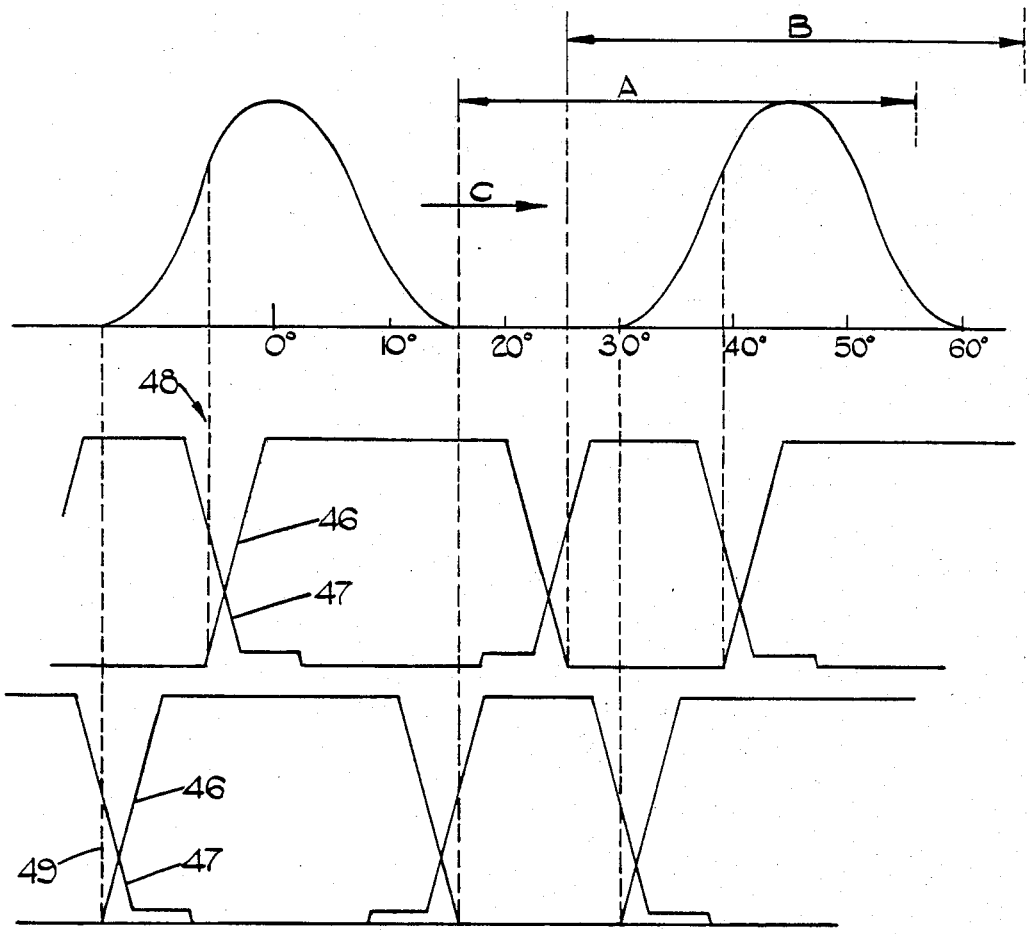
Figure 7:
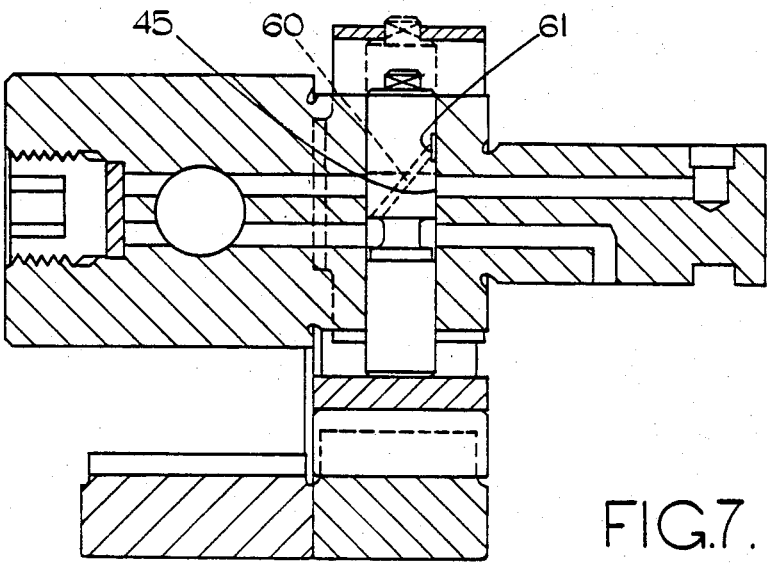
Figure 8:
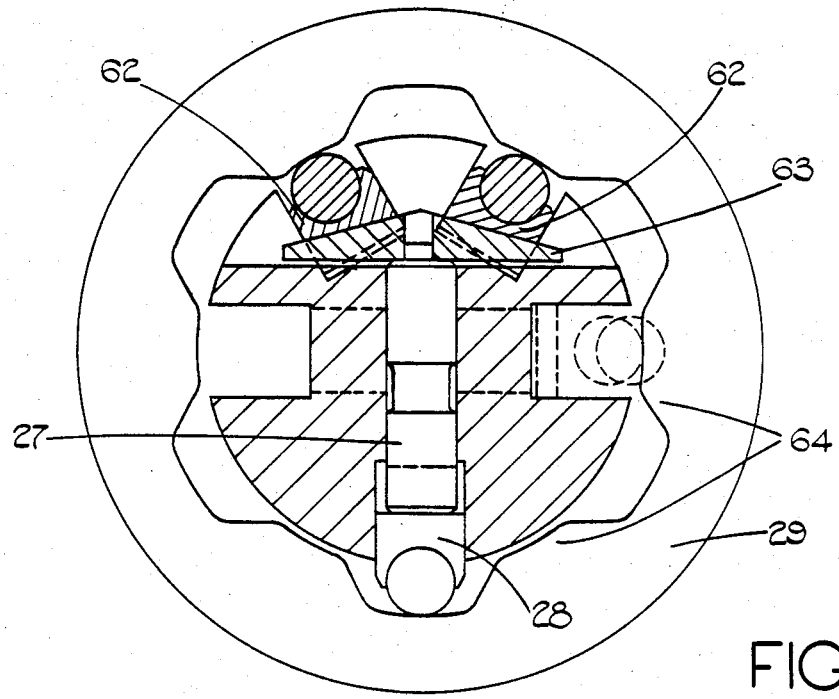

In the accompanying drawings:

FIG. 1 is a part sectional side elevation of a portion of pump in accordance with the invention, FIG. 2 is an exploded view of the rotary parts of the pump, FIG. 3 is a cross section taken on the line 3—3 of FIG. 1, FIGS. 4 and 5 are views similar to FIG. 3 showing first and second modifications, FIG. 6 is timing diagram of the pump, and FIGS. 7 and 8 show further modifications.

Referring to FIGS. 1–3 of the drawings the pump comprises a body indicated at 10 and in which is journalled a rotary cylindrical distributor member 11. The distributor member has an enlarged portion generally indicated at 12 extending into a chamber defined in the body and is coupled by means not shown, to a rotary drive shaft 13 which is mounted within the body and which extends to the exterior thereof. The drive shaft 13 is coupled in use to a rotary part of the associated engine so that the distributor member is driven in timed relationship with the engine. The drive shaft carries a cup shaped portion 14 which surrounds part of the enlarged portion of the distributor member and in which part there is formed a transversely extending bore 15 in which is mounted a pair of pumping plungers 16. At the outer ends of the pumping plungers are located cam followers 17 respectively which comprise a shoe carrying a roller, the roller co-operating in use with an annular cam ring 18 carried within the body.

The cam followers are slidably mounted in slots 19 in the cup-shaped portion 14 so that the driving force required to drive the cam followers is transmitted directly from the drive shaft rather than through the distributor member.

Formed in the distributor member are a pair of longitudinally extending passages 20, 21 both passages communicate with the bore 15 and the passages are disposed in spaced side-by-side relationship. The passage 21 at its end remote from the bore 15 communicates with a delivery passage 22 which is positioned to register in turn with outlets 23 formed in the body. The outlets in use, are connected possibly by way of delivery valves, to the injection nozzles respectively of the associated engine. The passage 20 extends beyond the passage 22 and communicates with a circumferential groove 24 formed in the periphery of the distributor member. The groove 24 is in permanent communication with the outlet of a low pressure supply pump shown in block form at 25. In practice the rotary part of the low pressure pump will be connected to the distributor member 11 so as to be driven thereby. The low pressure pump, as is well known in the art, will incorporate a relief valve so that the output pressure is controlled.

The passages 20 and 21 extend through a bore 26 formed in the distributor member, the axis of the bore 26 conveniently being at right angles to that of the bore 15. Slidable within the bore 26 is a cylindrical valve member 27 which at one end is contacted by a cam follower 28. The cam follower includes a shoe which supports a roller arranged to co-operate with the internal peripheral surface of a cam ring 29. The cam follower 28 is located within a groove 30 defined between a first pair of projections 31, 32 on the cup-shaped portion 14. The cup-shaped portion 14, as is clearly seen in FIG. 2, defines a further pair of projections 33, 34. The enlarged portion of the distributor member in the region of the bore 26 is provided with a pair of flats 35 which extend substantially parallel to the axis of the bore 26 and slidable on the flats is a stirrup member 36 having a pair of side limbs 37 which are connected by a curved portion 38. The portion 38 is provided with a central aperture in which is located the reduced end of the valve member 27. The side limbs at their other ends have outwardly turned portions 39 which are provided with central projections 40 which serve to locate the ends of a pair of coiled compression springs 41 the other ends of which are located by similar projections 42 defined on the projections 33, 34 respectively. The springs act to bias the valve member 27 downwardly as seen in the drawings so that the roller of the cam follower 28 contacts the internal surface of the cam ring 29.

The valve member 27 is provided with a groove 43 intermediate its ends and in the inoperative position of the valve member as shown in FIGS. 1 and 2, the groove 43 is aligned with the passage 21 so that flow of fuel can take place along the passage 21 from the bore 15 to the delivery passage 22. The groove 43 is in constant communication with the bore 15.

The valve member 27 is moved to its operative position by the action of a lobe on the cam ring 29 and as it moves to the operative position the end wall 44 of the groove 43 uncovers a spill port 45 constituted by the passage 20 at its point of entry from the groove 24 into the bore 26. At the same time the end wall 44 uncovers the remaining portion of the passage 20 and during continued movement of the valve member 27 to its operative position, the communication between the portions of the passage 20 will increase and the communication between the portion of the passage 21 which is connected to the delivery passage 22 will decrease.

Considering now the mode of operation of the pump so far described. As shown in FIG. 1 the delivery passage 22 is in communication with an outlet 23 and the valve member 27 is in its inoperative position. This corresponds to inward movement of the pumping plungers 16 and fuel is being supplied to an outlet 23 and hence to the associated engine. While the delivery passage 22 is in communication with an outlet, the valve member will start to move inwardly and when the side wall or control edge 44 of the groove 43 uncovers the port 45, fuel will be spilled to the low pressure pump 25. The supply of fuel through the outlet 23 will therefore cease and if the outlet 23 has a delivery valve, the latter will close. It should be noted that before the spill port is uncovered, the area of the passage 21 is reduced by the valve member and this reduction in area is used to control the rate at which fuel returns from the pipeline associated with the outlet receiving fuel. This control of the return flow when either no delivery valve is employed or where the delivery valve is of the unloading type, helps to minimize the risk of secondary injection of fuel taking place due to reflected pressure waves generated by closure of the valve member in the fuel injection nozzle.

When the inward movement of the plungers 16 has ceased, they can commence their outward movement under the action of fuel under pressure supplied by the low pressure pump 25 and the valve member remains in its operative position for a length of time sufficient to allow the complete filling of the bore 15. It should be noted that filling of the bore 15 can take place while the delivery passage 22 is still in register with an outlet 23 and this means that the pressure in the column of fuel between the bore 15 and the pipeline or between the bore 15 and the delivery valve, will be reduced to that of the output pressure of the pump 25. This ensures that the pressure within the passages in the pump is equal at the start of every period of fuel delivery. As the distributor member continues to rotate the cam lobe on the cam ring 29 will allow the valve member to move to the inoperative position in which it is shown, under the action of the springs 41. Flow through the passage 24 is thereby prevented and the pump is ready for the next delivery of fuel, it being appreciated that the delivery passage 22 will be moving towards the next outlet 23.

It is arranged that the valve member 27 is moved to cause spilling of fuel before the crests of the cam lobes on the cam ring are reached. The fuel pressure in the bore 15 is therefore substantially reduced before the rollers of the cam followers 17 move over the crests of the cam lobes. There is therefore a substantial reduction in the stress imparted to the cam lobes and therefore the cam ring 18 and the cam lobes can be made from a cheaper material as compared with the type of pump in which pumping occurs over the crests of the cam lobes.

Turning now to FIG. 6 this shows in the upper part of the FIGURE, the profile of the lobes on the cam ring 18. It will be seen that the lobes are symmetrical about their axes and in the particular example the axes are angularly spaced by 45° since the pump is intended to supply fuel to an eight cylinder engine. Above the profile of the cam lobes, two equal periods A and B are indicated, both periods represent the timing during which the delivery passage 22 is open to an outlet 23. The length of the period is of course determined by the diameters of the passage 22 and the ports 23. Period A shows the period relative to the cam lobes, when the cam ring 18 is moved to the retarded position whereas period B shows the situation when the cam ring is moved to the advanced position, the direction of movement of the followers relative to the cam lobes being indicated by the arrow C.

Turning now to the lower portion of the FIGURE, two curves 46 and 47 are indicated and these are related to the movement of the valve member 27 between its two extreme positions under the action of the lobes on the cam ring 29. The curve 47 illustrates the effect of the valve on the flow through the passage 21 and the curve 46 the flow through the passage 20. In the case of the curve 46 the lower portion of the curve represents the situation when the parts of the passage 20 are out of communication with each other due to the fact that the valve member 27 is in the so-called inoperative position and with the valve in this position the portions of the passages 21 are in communication with each other. Considering the upper one of the two lower diagrams it will be seen that the valve member is moved by a cam lobe and initially the movement starts to reduce the extent of communication between the parts of the passage 21. However, this restriciton is not sufficient to cause any restriction to the flow of fuel and at a point indicated at 48, the spill port 45 is opened. The effect of opening the spill port is to lower the pressure in the bore 15 to below that which is necessary to maintain fuel flow to the injection nozzle. Injection of fuel to the associated engine therefore ceases at the point 48 and it will be noted that in the upper diagram this is approximately two thirds the way up the leading flank of the cam lobe on the cam ring 18. The valve member continues to move under the action of the lobe on the cam ring 29 and the spill port is progressively opened. At the same time the communication between the parts of the passage 21 is progressively closed and it will be noted that there is a step in the curve 47, this step corresponding to a reduced portion 48A on the valve member 27. The purpose of this reduced portion is to control the rate at which fuel flows from the pipeline thereby, as previously mentioned, reducing the possiblity of secondary injection due to reflected pressure waves. It will be noted that filling of the bore 15 can occur as soon as the followers have moved over the crests of the cam lobes. The duration of the filling period in terms of degrees, depends upon the position of the cam ring 29. The upper diagram shows the setting of the cam ring 29 to obtain maximum fuel and it will be observed that the filling period is between 20° and 25°. The filling period is determined by the interval in terms of degrees, between the axis or crest of the cam lobe and the closure of the spill port 45. The lower diagram represents zero fuel since it will be observed that the spill port opens at the point 49 which corresponds to the initial portion of the cam lobe. There is therefore no displacement of the plungers while the spill port is closed and hence all the fuel contained in the bore will be displaced back to the supply pump 25. It should be noted that as the quantity of fuel delivered to the engine reduces, so also does the filling period. It must be remembered however that the bore 15 must be completely filled with fuel each time the plungers are allowed to move outwardly but even when the cam ring 29 is set for zero fuel, the filling period is of the order of 15°. In the case of a pump for supplying fuel to a six cylinder engine the filling period at the maximum fuel setting is about 40° and in the case of a pump for supplying fuel to a four cylinder engine, about 70°.

It will be appreciated that if the cam ring 18 is moved without movement of the cam ring 29, the amount of fuel delivered will vary. If therefore it is necessary to keep the quantity of fuel constant while varying the timing, both cam rings must be moved.

Turning now to FIG. 4, there is shown a modified form of biasing arrangement for the valve member 27. In this case the portion of the distributor member 11 which carries the valve member is of generally rectangular section and the stirrup referenced 50, is of generally complementary shape. The lateral projections 51 on the stirrup are provided with central apertures through which extend pins 52 only one of which is shown, which are secured to a plate 53 which engages due to spring forces, with the adjacent face of the distributor member. The pins 52 carry heads 54 which are engaged by the springs 41, the opposite ends of the springs engaging the lateral projections 51. The stirrup is also provided, as is the stirrup of the examples shown in FIGS. 1–3, with retaining plates 55 the purpose of which is to prevent axial movement of the followers 17 associated with the plungers 16. In this arrangement a lateral force will be imparted to the distributor member due to the effect of the springs 41. This is because of reaction of the springs is transmitted by the plate 53 to the distributor member. This is not the case with the example of FIGS. 1–3 since the spring reaction is absorbed by the projections 33, 34 which are carried by the cup-shaped member 14.

In the example of FIG. 5 there again will be a lateral force applied to the distributor member. In this case the distributor member 11 is provided with a flat 56 to which is secured a stirrup 57 the latter providing an abutment for a pair of springs 58 the opposite ends of which engage a plate 59 carried on the valve member 27.

Returning now to FIG. 1, it will be noted that the valve member 27 is provided with a small drilling 60 which extends from the groove 43 to a position adjacent the end of the valve member remote from the follower 28. The drilling is uncovered beyond the end of the bore 26 as the valve member is moved towards its operative position. The drilling is not uncovered until after the spill port 45 has been uncovered but when it is uncovered, a flow of fuel will take place to a space defined in the body. This flow of fuel will facilitate the removal of air from the passges in the distributor member and it will also ensure that fresh fuel does flow through the pump 25 and the passages within the distributor member when for example the associated engine is operating at high speed with no fuel being supplied to it as for example when a vehicle powered by the engine is descending a hill.

FIG. 7 also shows the drilling 60 but in this case it terminates in a small groove 61 on the valve member on the same side of the valve member as the spill port 45. The purpose of the groove 61 is to achieve a measure of balance of the side load imposed upon the valve member by the fuel under pressure in the portion of the passage 20 opposite the spill port 45. It will be appreciated that during delivery of fuel to the engine the pressure in the aforesiad portion of the passage 20 is high and this pressure acts upon the valve member. By providing the groove 61 an opposite force is applied to the valve member to provide some measure of balance. Clearly the valve member in this situation cannot be allowed to rotate and hence the aperture in the stirrup and also the end portion of the valve member engaging within the aperture, are of non-circular form to prevent rotation of the valve member.

In the arrangements so far described, the valve member has been returned to its inoperative position by the action of the springs. It is anticipated that this method or returning the valve member will be perfectly acceptable for compression ignition engines of the four stroke variety fitted in commercial vehicles. Where however it is used with two stroke engines the speed of rotation of the distributor member may be such that spring return is not longer acceptable. For such cases positive return of the valve member may be used.

An example of such an arrangement is seen in FIG. 8, the pump in this case being intended to supply fuel to a six cylinder engine. As will be observed, the spring is replaced by a pair of cam followers 62 which are carried upon a bridge member 63. The cam followers have their lines of action angularly spaced by 30° from the axis of movement of the valve member 27. The cam followers include rollers which engage with the lobes 64 on the internal surface of the cam ring 29. With this arrangement the dwell periods in terms of degrees of rotations of the distribution member, when the valve member is in its operative and inoperative positions are equal.

In the examples described the valve member 27 is of one piece construction. It may however be formed in two parts with the division being in the region of the groove 43.

I claim:

1. A rotary distributor type fuel injection pump for supplying fuel to internal combustion engines more particularly of the compression ignition type, the pump comprising a rotary distributor member mounted in a pump body and arranged in use to be driven in timed relationship with the associated engine, a pump bore formed in the distributor member, a reciprocable pumping plunger slidable in the pump bore, cam means including a cam lobe for effecting inward movement of the pumping plunger as the distributor member rotates, a delivery passage in the distributor member and an outlet port in the body, said delivery passage communicating with said pump bore and being positioned to register with said outlet when fuel is displaced from said pump bore, means for supplying fuel to said pump bore and fuel control means for controlling the amount of fuel supplied to said outlet, said fuel control means including a valve member carried by the distributor member and further cam means for actuating said valve member, said valve member when in an operative position causing fuel to spill from said pump bore, said valve member being slidable in a radial bore in the distributor member, a pair of ports opening into said bore at axially spaced positions, one of said ports communicating with said delivery passage and the other port with a low pressure, said valve member being of cylindrical form having a groove intermediate its ends, said groove communicating with said pump bore, the arrangement being such that when the valve member is in its inoperative position said one port will be open to said groove and the pump bore but in the operative position of the valve member, said other port will be open to said groove to allow fuel to spill from the bore, the one port during movement of the valve member to its operative position being progressively covered to control the rate at which fuel can flow from said outlet.

2. A pump according to claim 1 in which said other port is connected with a fuel supply passage in the distributor member, said fuel supply passage communicating with the outlet of a low pressure fuel supply pump.

3. A pump according to claim 2 in which said valve member is retained in its operative position to allow fuel to flow into said pump bore when the pump plunger is permitted outward movement by said cam lobe.

4. A pump according to claim 3 in which said fuel supply passage and a passage connecting said one port with the delivery passage extend in side by side relationship within the distributor member, the passages extending through said radial bore into said pump bore.

5. A pump according to claim 3 in which said valve member defines a reduced portion formed as an extension of said groove, said reduced portion acting to further control the flow of fuel through said one port as the valve member is moved to its operative position.

6. A pump according to claim 3 including resilient means biasing said valve member to its inoperative position.

7. A pump according to claim 6 including a stirrup member having a pair of side limbs connected by an end portion, one end of said valve member engaging said end portion, the other end of said valve member being engaged by a cam follower which engages said cam means, said side limbs of the stirrup being slidable on a pair of flats formed on the distributor member, outwardly extending portions on said side limbs and a pair of springs having ends engaged with said outwardly enxtending portions respectively, said springs acting to bias the valve member to its inoperative position.

8. A pump according to claim 7 in which the opposite ends of said springs are engaged with a part rotatable with said distributor member.

9. A pump according to claim 7 in which the opposite ends of said springs are engaged with a part carried by said distributor member.

10. A pump according to claim 4 including interengageable means on the valve member and said end portion to prevent rotation of the valve member.

11. A pump according to claim 10 including a recess on the valve member said recess being in communication with said groove and acting to provide pressure balance of the valve member.

12. A pump according to claim 3 including a single cam follower disposed at one end of the valve member and a pair of cam followers at the opposite end of the valve member, said pair of cam followers and the cam follower being disposed to move said valve member between its operative and inoperative positions.

* * * * *